US008365929B2

(12) United States Patent
Luo

(10) Patent No.: US 8,365,929 B2
(45) Date of Patent: Feb. 5, 2013

(54) CABINET FRAME FOR EASY ASSEMBLY

(75) Inventor: Cun Neng Luo, Shenzhen (CN)

(73) Assignee: Shenzhen Yeefu Precision Machinery Co., Ltd., Shenzhen (CN)

( * ) Notice: Subject to any disclaimer, the term of this patent is extended or adjusted under 35 U.S.C. 154(b) by 192 days.

(21) Appl. No.: 12/789,443

(22) Filed: May 27, 2010

(65) Prior Publication Data

US 2010/0314982 A1 Dec. 16, 2010

(51) Int. Cl.
*A47F 5/01* (2006.01)
*A47B 96/14* (2006.01)

(52) U.S. Cl. ..... 211/183; 312/265.4

(58) Field of Classification Search ..... 211/26, 211/183, 182, 189; 312/265.1–265.4, 223.1; 403/169, 170, 171, 176
See application file for complete search history.

(56) References Cited

U.S. PATENT DOCUMENTS

| | | | | |
|---|---|---|---|---|
| 3,542,407 | A * | 11/1970 | Brown | 403/172 |
| 4,997,240 | A | 3/1991 | Schmalzl et al. | |
| 5,423,604 | A * | 6/1995 | Chern | 312/265.1 |
| 5,749,476 | A * | 5/1998 | Besserer et al. | 211/26 |
| 5,997,117 | A * | 12/1999 | Krietzman | 312/265.4 |
| 6,062,664 | A * | 5/2000 | Benner | 312/265.1 |
| 6,315,132 | B1 * | 11/2001 | Hartel et al. | 211/26 |
| 6,332,657 | B1 * | 12/2001 | Fischer | 312/111 |
| 6,575,657 | B1 * | 6/2003 | Reuter et al. | 403/231 |
| 6,902,068 | B1 * | 6/2005 | Fontana et al. | 211/26 |
| 2001/0037988 | A1 * | 11/2001 | Knab et al. | 211/189 |
| 2006/0182492 | A1 * | 8/2006 | Keller | 403/170 |
| 2008/0218042 | A1 * | 9/2008 | Hartel et al. | 312/265.4 |
| 2011/0012489 | A1 * | 1/2011 | Shen et al. | 312/326 |
| 2011/0050052 | A1 * | 3/2011 | Elkins et al. | 312/223.1 |
| 2011/0309046 | A1 * | 12/2011 | Lee | 211/182 |
| 2012/0012544 | A1 * | 1/2012 | Fan | 211/26 |

FOREIGN PATENT DOCUMENTS

| | | | |
|---|---|---|---|
| CN | 201111315 | Y | 9/2008 |
| CN | 101577398 | A | 11/2009 |
| DE | 29823389 | U1 | 6/1999 |

OTHER PUBLICATIONS

EPO Espacenet, Abstract of CN101577398, Nov. 11, 2009.
EPO Espacenet, Abstract of CN201111315, Sep. 3, 2008.

* cited by examiner

*Primary Examiner* — Michael Safavi
*Assistant Examiner* — Devin Barnett

(57) ABSTRACT

A cabinet frame for easy assembly includes an upper frame and a lower frame each constituted of four corner connectors and four transverse capping pieces, and four longitudinal capping pieces connected between four corners of the upper frame and the lower frame, characterized in that: sixteen prismatic rods are used for connecting corner connectors on four corners of the upper frame and the lower frame with the longitudinal capping pieces, the corner connector being provided with protrusions and countersinks, the cross section of each of the transverse capping pieces and the longitudinal capping pieces being formed into a "⊔" shape, square bores on both ends of the capping pieces being inserted by the protrusions of the corner connectors. The cabinet frame of the present invention is easy for assembly and has a simple structure. The frame constituted by assembling the corner connectors with the prismatic rods has a stable structure and a large load-bearing capacity. Furthermore, since each of the capping pieces has several mounting surfaces, the thus-obtained cabinet frame can be configured as different forms with flexible and changeable internal space, thereby conforming to the demands for products of different standards and dimensions.

5 Claims, 7 Drawing Sheets

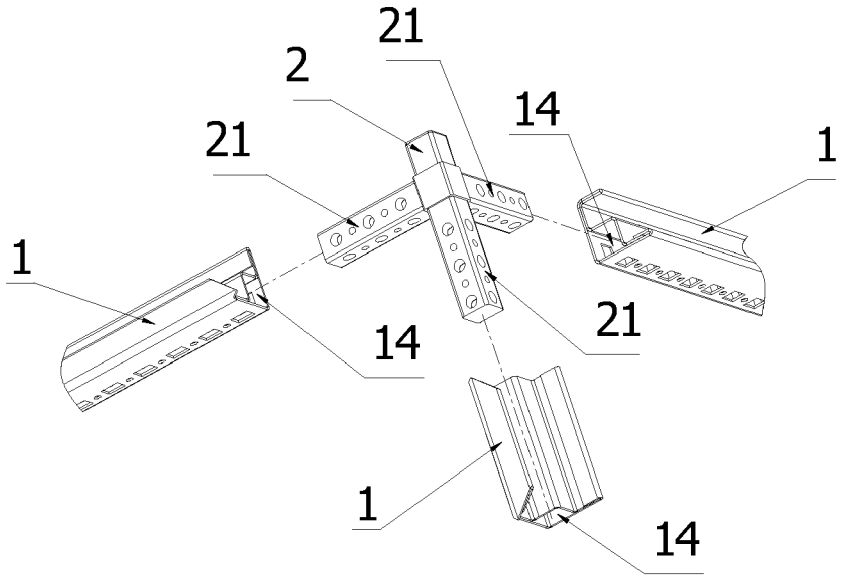
FIG. 1, Prior Art
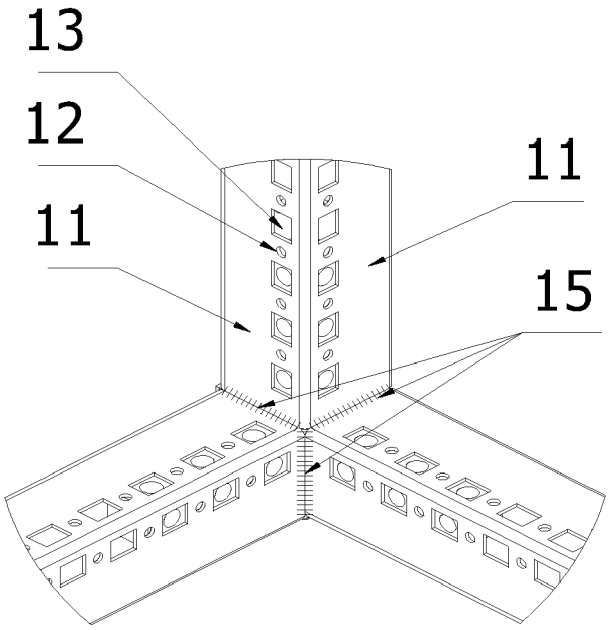
FIG. 2, Prior Art

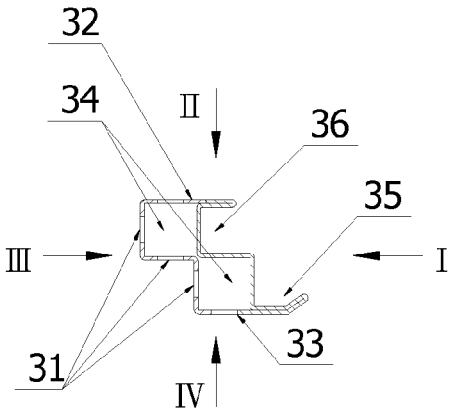
FIG. 4.1
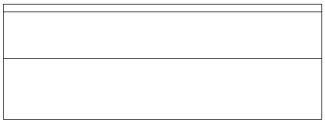
FIG. 4.2
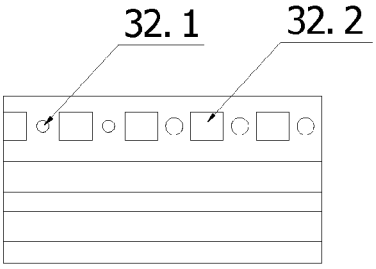
FIG. 4.3
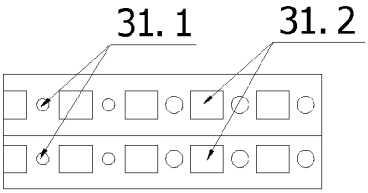
FIG. 4.4
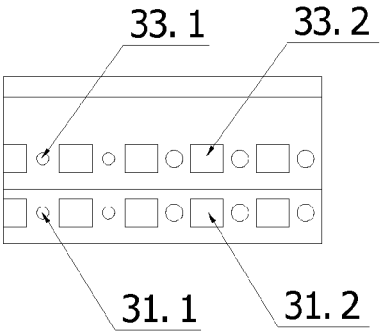
FIG. 4.5
FIG. 4

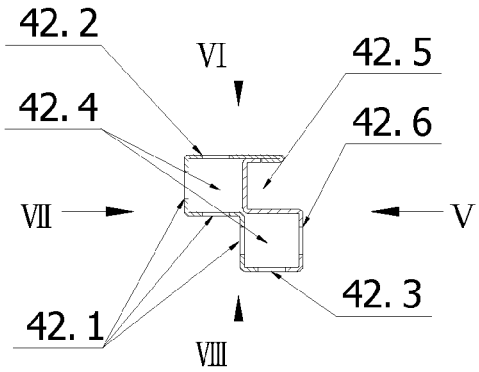
FIG.. 5.1
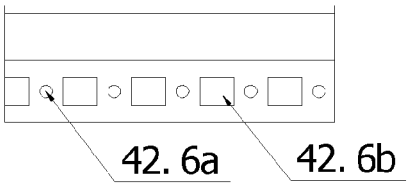
FIG.. 5.2
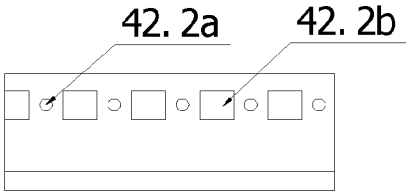
FIG.. 5.3
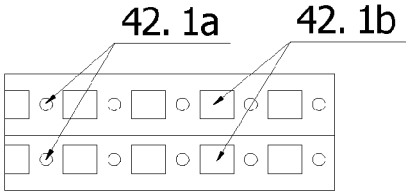
FIG.. 5.4
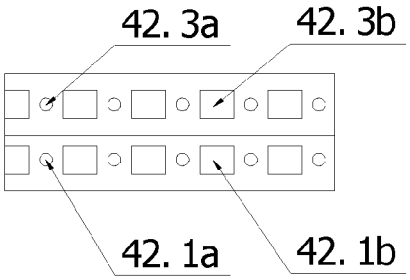
FIG.. 5.5
FIG. 5

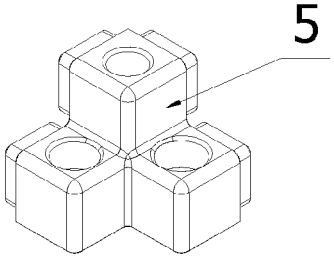
FIG. 7.1
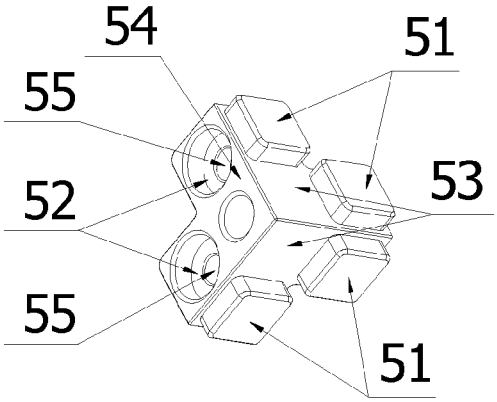
FIG. 7.2
FIG. 7
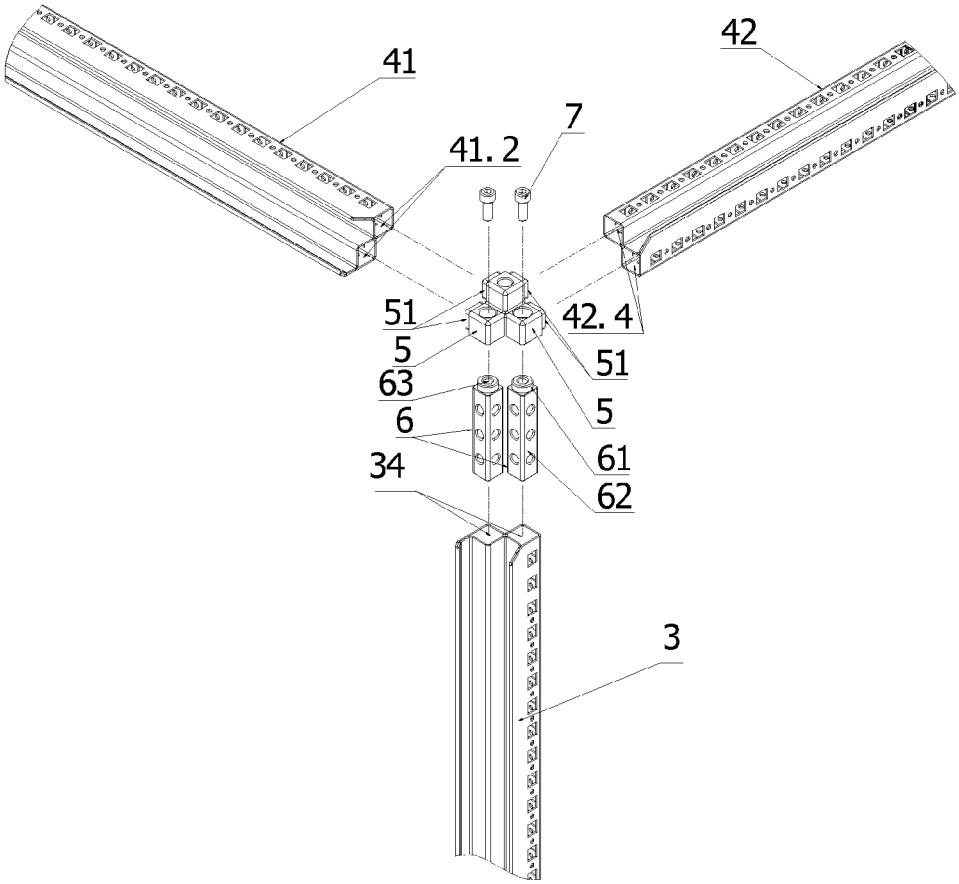
FIG. 8

CABINET FRAME FOR EASY ASSEMBLY

BACKGROUND OF THE INVENTION

1. Field of the Invention

The present invention relates to a cabinet frame, and in particular to a cabinet frame for easy assembly and a method for assembling the same.

2. Description of Prior Art

Existing cabinets are usually constituted of a frame, a door, wall plates and capping pieces. The frame is the major component of the cabinet, which is formed into an upright rectangular parallelepiped. DE 3344598 discloses a cabinet having a rectangular frame that is constituted of twelve capping pieces and eight corner connectors. As shown in FIGS. 1 and 2, each of the capping pieces 1 in such a cabinet frame has two inner surfaces 11 facing toward the inner space of the frame. The two inner surfaces are perpendicular to each other to form a crest line. Both of the inner surfaces 11 are provided with fixing holes 12 and 13 arranged at equal intervals. Such a capping piece can only achieve limited types of constructions by using the fixing holes 12 and 13 on its both inner surfaces 11. Since such a capping piece only has two mounting surfaces, the frame constituted by these capping pieces cannot extend arbitrarily on demands and thus lacks flexibility. Further, the corners of the cabinet frame are assembled with three-dimensional corner connectors 2. Each of the corner connectors 2 is constituted of three rectangular prisms 21 perpendicular to one another. The rectangular prism 21 is inserted into a bore 14 formed in the capping piece. Then, the connecting portions 15 between the capping pieces are welded together, thereby generating a firm and safe construction with sufficient strength and rigidness.

However, such a cabinet frame has some disadvantages. The frame with the capping pieces welded together forms into one rigid body, so that it cannot be disassembled, which increases the expense of transportation and storage. Furthermore, during the welding process, expensive large-sized clamping tools have to be used for positioning the capping pieces. The frame may suffer deformation after welding, which makes the finished cabinet frame inconsistent in its quality. In manufacturing the three-dimensional corner connectors by a machining process, more working hours, row materials and labors are needed. Thus, the manufacture of these three-dimensional corner connectors is difficult, high in cost, but low in efficiency, so that they are not suitable for mass production. If the corner connectors are to be manufactured by casting, internal defects may be easily generated in each of the corner connector. These defects cannot be inspected easily and may deteriorate the quality of the corner connector.

SUMMARY OF THE INVENTION

In order to overcome the above-mentioned technical problems, the object of the present invention is to provide a cabinet frame for easy assembly and a method for assembling the same. The cabinet frame of the present invention can withstand a greater load, and it can be assembled easily with more flexibility to fit various kinds of constructions.

In order to achieve the above object, the present invention provides a cabinet frame for easy assembly, which includes an upper frame and a lower frame each constituted of four corner connectors and four transverse capping pieces, four longitudinal capping pieces connected between the four corners of the upper frame and the lower frame, the transverse capping pieces and the longitudinal capping pieces being provided with fitting hole at intervals.

Such a cabinet frame for easy assembly has the following advantageous features.

Sixteen prismatic rods are provided. Each prismatic rod correspond to a square bore provided on one end of the transverse capping piece or the longitudinal capping piece in terms of profile and dimension. The prismatic rod can be inserted into the square bore of the longitudinal capping piece. One end of the prismatic rod is provided with a head portion inserted into a countersink of the corner connector. A screw hole is provided in the center of the head.

The corner connector is constituted of three right-angled surfaces perpendicular to one another. Two of the right-angled surfaces are provided with protrusions respectively inserted into the capping pieces, and the other right-angled surface is provided with two countersinks inserted by the head portions of two prismatic rods. The center of the countersink is provided with a through-hole.

The cross section of each of the transverse capping pieces and the longitudinal capping pieces is formed into a "⊔" shape. Each of the transverse capping pieces and the longitudinal capping pieces has three inner surfaces perpendicular to each other to a stepped surface. These three inner surfaces and two outer surfaces together form two square bores for allowing the protrusions of the corner connector to be inserted therein, so that each of the transverse capping pieces and the longitudinal capping pieces has six mounting surfaces. The protrusions of the corner connector are inserted into the square bores on both ends of the capping piece.

The present invention further has the following technical features.

Each of the three inner surfaces of the longitudinal capping piece or the transverse capping piece is provided with square fitting holes and circular fitting holes at intervals.

A corner of each of the two outer surfaces of the longitudinal capping piece is formed with an extension strip for forming a guide groove. As a result, the longitudinal capping piece is formed into a "⊔" shape, whereby water can flow from the top of the cabinet to the ground along the guide groove formed on the outer surfaces of the longitudinal capping pieces.

The upper frame and the lower frame are of equal structure, which is constituted of two front transverse capping pieces, two side transverse capping pieces and four corner connectors. The cross section of the front transverse capping piece is formed into a "⊔" shape having the same dimension as that of the longitudinal capping piece. The cross section of the side transverse capping piece is formed into a "⊏" shape. That is, a corner of the outer surface of the side transverse capping piece is provided with an extension strip for forming a groove. The upper frame or lower frame constituted by the transverse capping pieces has water-collecting grooves formed at the periphery thereof. Thus, the water can be first collected in the water-collecting grooves on the top of the cabinet, and then the water flows to the ground along the guide grooves on the outer surfaces of the longitudinal capping pieces.

Each surface of the prismatic rod is provided with holes corresponding to the square holes and circular holes on the inner surfaces of the longitudinal capping pieces.

The present invention also provides a method for assembling a cabinet frame, including steps of:

(1) inserting one ends of the sixteen prismatic rods into the square bores on both ends of the four longitudinal capping pieces with the head portions of the prismatic rods being exposed to both ends of the longitudinal capping pieces;

(2) selecting eight transverse capping pieces and eight corner connectors each having the same standard and dimension, inserting the protrusions of the corner connectors into the square bores on both ends of the transverse capping pieces respectively, welding the connecting portions between the transverse capping pieces and the corner connectors to form an upper frame and a lower frame respectively having the same standard and dimension;

(3) connecting the four longitudinal capping pieces mounted with the prismatic rods on both ends thereof to the upper frame and lower frame by inserting the head portions of the prismatic rods into the countersinks of the corner connectors on four corners of the upper frame and the lower frame respectively; and (4) inserting bolts through the through-holes of the corner connectors, screwing the bolts into the central screw holes of the head portions of the prismatic rods respectively to thereby assemble the longitudinal capping pieces with the upper frame and the lower frame, welding the connecting portions between the four corners of the upper frame and the lower frame with the longitudinal capping pieces to thereby form a firm and rigid cabinet frame.

In contrast to the prior art, the present invention has the following advantageous features.

The cabinet frame of the present invention is easy for assembly and has a simple structure. Further, since each of the capping pieces is formed into a "⊔" shape, the bending strength thereof is enhanced significantly. The frame constituted by assembling the corner connectors with the prismatic rods has a stable structure and a large load-bearing capacity. Furthermore, since each of the capping pieces has several mounting surfaces, the thus-obtained cabinet frame can be configured as different forms with flexible and changeable internal space. Therefore, the cabinet frame of the present invention conforms to the demands for products of different standards and dimensions.

The concrete structure of the present invention will be illustrated in detail with reference to the description of preferred embodiments thereof and the accompanying drawings.

BRIEF DESCRIPTION OF THE DRAWINGS

FIG. 1 is an exploded perspective view showing the structure of an existing cabinet frame;

FIG. 2 is a perspective view showing the connection of a corner of the existing cabinet frame shown in FIG. 1;

FIG. 4 is a schematic view showing a longitudinal capping piece and a front transverse capping piece of the cabinet frame of the present invention;

FIG. 4.1 is a cross-sectional view showing the longitudinal capping piece and the front transverse capping piece;

FIG. 4.2 is a schematic view showing the structure of FIG. 4.1 in I-axis direction;

FIG. 4.3 is a schematic view showing the structure of FIG. 4.1 in II-axis direction;

FIG. 4.4 is a schematic view showing the structure of FIG. 4.1 in III-axis direction;

FIG. 4.5 is a schematic view showing the structure of FIG. 4.1 in IV-axis direction;

FIG. 5 is a schematic view showing the structure of a side transverse capping piece of the cabinet frame of the present invention;

FIG. 5.1 is a cross-sectional view showing the side transverse capping piece;

FIG. 5.2 is a schematic view showing the structure of FIG. 5.1 in V-axis direction;

FIG. 5.3 is a schematic view showing the structure of FIG. 5.1 in VI-axis direction;

FIG. 5.4 is a schematic view showing the structure of FIG. 5.1 in VII-axis direction;

FIG. 5.5 is a schematic view showing the structure of FIG. 5.1 in VIII-axis direction;

FIG. 7 is a perspective view showing a corner connector of the cabinet frame of the present invention, wherein FIG. 7.1 is a schematic view showing the structure of the corner connector along the longitudinal direction of the longitudinal capping piece, and FIG. 7.2 is a schematic view showing the corner connector of FIG. 7.1 rotated with 180 degrees;

FIG. 8 is an exploded perspective view showing the connection of a corner of the cabinet frame of the present invention.

DETAILED DESCRIPTION OF THE INVENTION

Figure 3:
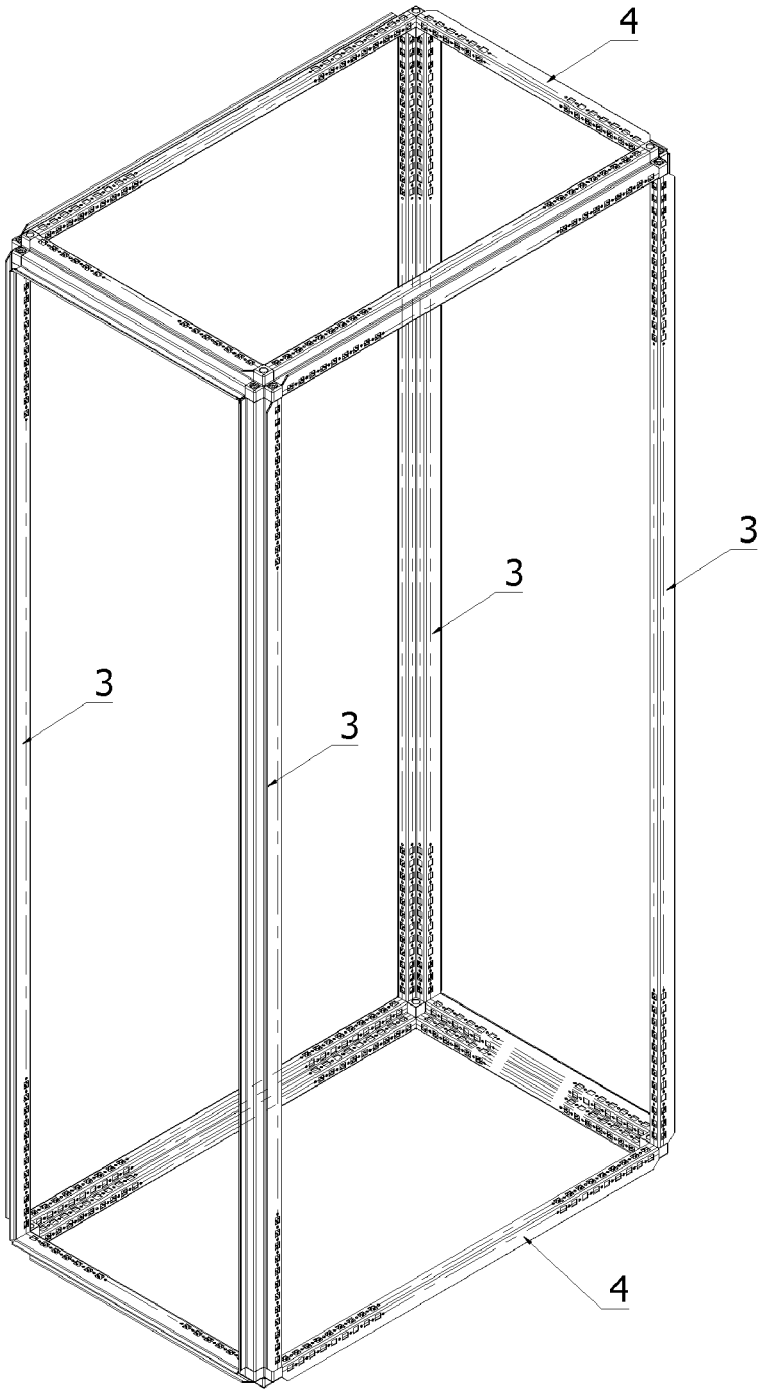
FIG. 3 is a perspective view showing the structure of a cabinet frame of the present invention.
Figure 6:
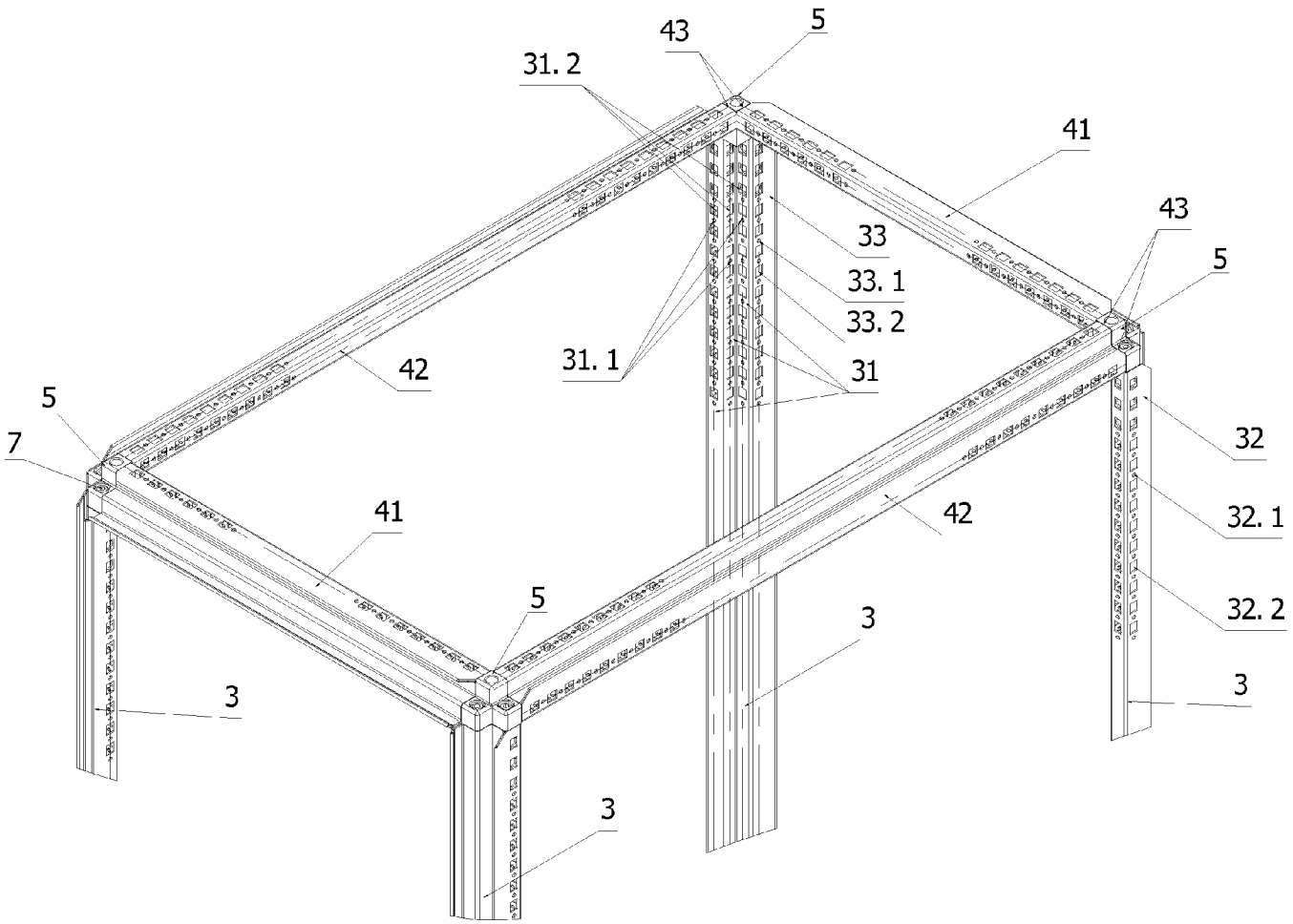
FIG. 6 is a schematic view showing an upper portion of the cabinet frame of the present invention.
Figure 9:
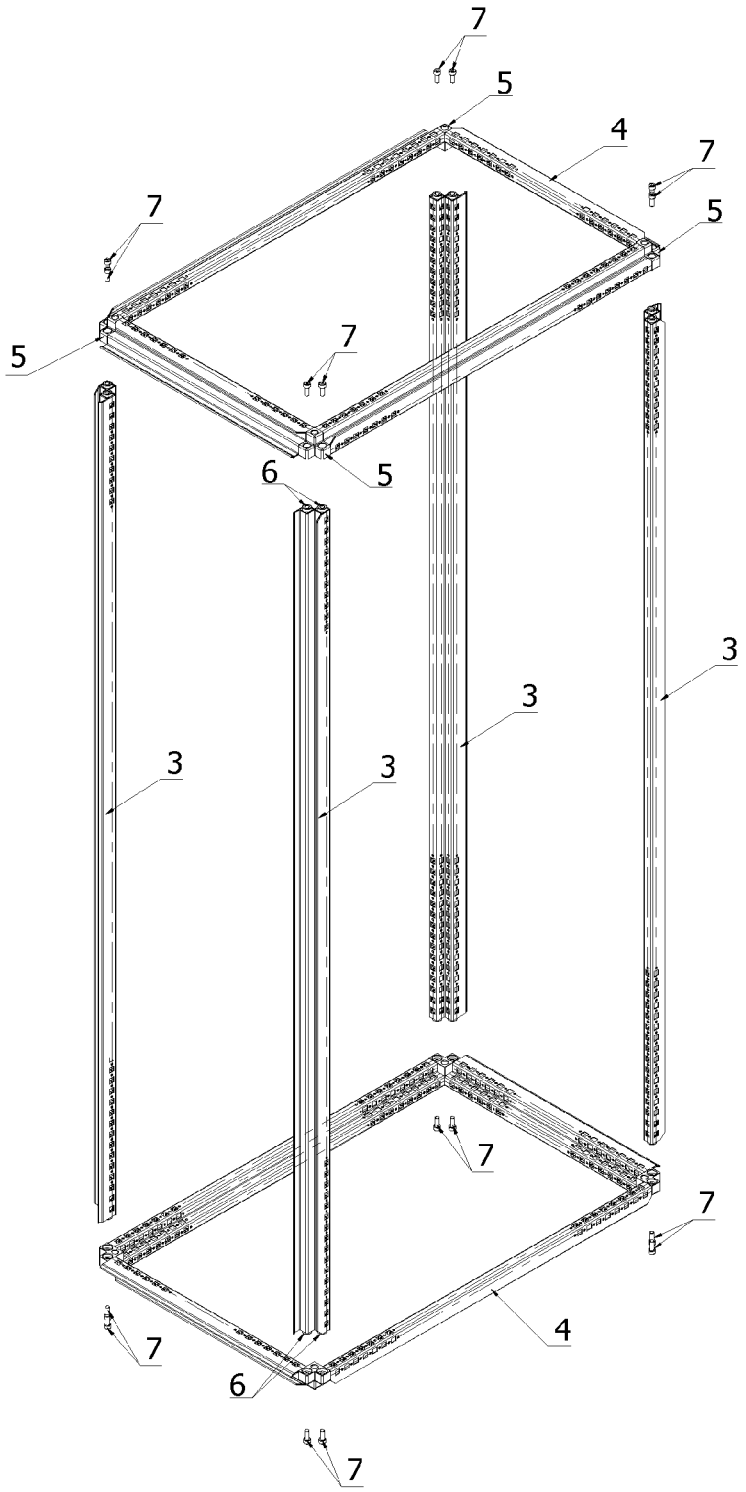
FIG. 9 is an exploded perspective view showing the upper frame, the lower frame and the longitudinal capping pieces of the cabinet frame of the present invention.

Please refer to FIGS. 3 to 9. The present invention provides a cabinet frame for easy assembly, which includes four longitudinal capping pieces 3, an upper frame 4 and a lower frame 4 of the same structure, eight corner connectors 5, and sixteen prismatic rods 6.

As shown in FIG. 7, the corner connector 5 has three right-angled surfaces 53, 54 perpendicular to each other. Two corners of the two right-angled surfaces 53 are respectively formed with protrusions 51 for inserting into square bores of each of the capping pieces. Two corners of the other right-angled surface 54 are formed with countersinks 52 for allowing head portions of the prismatic rods 6 to be inserted therein. The center of the countersink 52 is provided with a through-hole 55.

As shown in FIG. 4, the longitudinal capping piece 3 is formed into a "⊔" shape. The longitudinal capping piece 3 has three inner surfaces 31 perpendicular to each other to form a stepped surface and two outer surfaces 32, 33. The inner surfaces 31 and the outer surfaces 32, 33 together form two square bores 34 for allowing the protrusions 51 of the corner connector 5 to be inserted therein. Two corners of the outer surfaces 31 of the longitudinal capping piece 31 are formed with extension strips for forming two guide grooves 35 and 36 respectively. The three inner surfaces 31 and the two outer surfaces 32, 33 are provided thereon with square holes 31.2, 32.2, 33.2 and circular holes 31.1, 32.1, 33.1 at intervals. The square holes 31.2, 32.2, 33.2 and the circular holes 31.1, 32.1, 33.1 on the inner surface 31 have the same dimension and are arranged in a line with equal intervals. The five mounting surfaces formed by the longitudinal capping piece 3 increase the degree of freedom when mounted in the longitudinal direction, thereby generating different combinations for fixation.

As shown in FIG. 8, the prismatic rod 6 is connected between the upper frame or lower frame 4 and the longitudinal capping piece 3. The profile and dimension of the prismatic rod 6 correspond to those of the square bore 34 on one end of the longitudinal capping piece 3, so that the prismatic rod 6 can be inserted into the square bore 34 of the longitudinal capping piece 3. One end of the prismatic rod 6 is provided with a head portion 61 inserted into the countersink 52 of the corner connector 5. The center of the head portion 61 is provided with a screw hole 63. The head portion 61 of the prismatic rod 6 is inserted into the countersink 52 of the corner connector 5. A bolt 7 is used to penetrate the through-hole 55 of the corner connector 5 and the screw hole 63 of the prismatic rod 6, thereby fixing the corner connector 5 to the prismatic rod 6. A tail portion 63 of the prismatic rod 6 is inserted into the square bore 34 of the longitudinal capping piece 3, thereby connecting the prismatic rod 6 to the longitudinal capping piece 3.

The upper frame and the lower frame 4 are of the same structure. Each of the upper frame and the lower frame is constituted of front transverse capping pieces 41, side transverse capping pieces 42 and the corner connectors 5. The cross section of the front transverse capping piece 41 is formed into a "⊏" shape, which is identical to the longitudinal capping piece 3 in terms of shape and dimension. Each end of the front transverse capping piece 41 is provided with a square bore 41.2. As shown in FIG. 5, the cross section of the side transverse capping piece 42 is formed into a "⊏" shape, which has three inner surfaces 42.1 perpendicular to one another to form a stepped surface and two outer surfaces 42.2, 43.3. Two square bores 42.4 are formed by the inner surfaces 42.1, the outer surfaces 42.2, 42.3, and another outer surface 42.6. An extension strip of the outer surface 42.2 and the outer surface forms a groove 42.5. The three inner surfaces 42.1 and the outer surfaces 42.2, 42.3, 42.6 are formed thereon with square fitting holes 42.1*b*, 42.2*b*, 42.3*b*, 42.6*b* and circular fitting holes 42.1*a*, 42.2*a*, 42.3*a*, 42.6*a* at intervals. The square fitting holes 42.1*b*, 42.2*b*, 42.3*b*, 42.6*b* and the circular fitting holes 42.1*a*, 42.2*a*, 42.3*a*, 42.6*a* have the same dimension and are arranged in a line with equal intervals. With this arrangement, six mounting surfaces can be formed, thereby generating different combinations for fixation.

The method for assembling a cabinet frame of the present invention includes the following steps.

(1) One ends of the sixteen prismatic rods 6 are inserted into the square bores 34 on both ends of the four longitudinal capping pieces 3 with the head portions 61 of the prismatic rods 6 being exposed to both ends of the longitudinal capping pieces 3.

(2) Four front transverse capping pieces 41, four side transverse capping pieces 42, and eight corner connectors 5 are selected, each of which has the same standard and dimension. The square bores 41.2, 42.4 on both ends of the front transverse capping pieces 41 and the side transverse capping pieces 42 are inserted by the protrusions 51 of the corner connectors 5. The connecting portions between the front transverse capping pieces 41, the side transverse capping piece 42 and the corner connectors 5 are welded to form an upper frame and a lower frame 4 respectively.

Then, the four longitudinal capping pieces 3 mounted with prismatic rods 6 on both ends are connected to the upper frame and lower frame 4 by inserting the head portions 61 of the prismatic rods 6 into the countersinks 52 of the corner connectors 5 on four corners of the upper frame and the lower frame 4 respectively.

Thereafter, bolts 7 are used to penetrate through-holes 55 of the corner connectors 5. With the bolts 7 being screwed to the central screw holes 63 of the head portions 61 of the prismatic rods 6 respectively, the longitudinal capping pieces 3 can be assembled with the upper frame and the lower frame 4. Then, the connecting portions between the four corners of the upper frame and the lower frame 4 and the longitudinal capping pieces 3 are welded to form a firm and rigid cabinet frame.

Although the present invention has been described with reference to the foregoing preferred embodiment, it will be understood that the invention is not limited to the details thereof. Various equivalent variations and modifications may be designed as known to those skilled in the art in view of the teachings of the present invention. Thus, all such variations and equivalent modifications are also embraced within the scope of the invention as defined in the appended claims.

What is claimed is:

1. A cabinet frame for easy assembly, comprising: an upper frame and a lower frame each constituted of four corner connectors and four transverse capping pieces; four longitudinal capping pieces connected between four corners of the upper frame and the lower frame, the transverse capping pieces and the longitudinal capping pieces being provided with fitting holes at intervals, characterized in that:

sixteen prismatic rods are provided, each prismatic rod correspond to a square bore provided on one end of the transverse capping piece or the longitudinal capping piece in terms of profile and dimension, the prismatic rod can be inserted into a square bore of the longitudinal capping piece, one end of the prismatic rod is provided with a head portion inserted into a countersink of the corner connector, a screw hole is provided in the center of the head;

the corner connector is constituted of three right-angled surfaces perpendicular to one another, two of the right-angled surfaces are provided with protrusions respectively inserted into the capping pieces, and the other right-angled surface is provided with two countersinks inserted by the head portions of two prismatic rods, the center of the countersink is provided with a through-hole;

the cross section of each of the transverse capping pieces and the longitudinal capping pieces is formed into a cross-sectional shape defined by two squares with first, second, third and fourth surfaces of one bore forming a first square and fifth, sixth, seventh and eighth surfaces of a second bore forming a second square, the second and third surfaces meeting at a corner and the fifth and eighth surfaces meeting at the same corner so that one corner of the first square is attached to one corner of the second square with the third and fifth surfaces being coplanar, each of the transverse capping pieces and the longitudinal capping pieces has three inner surfaces perpendicular to each other to form a stepped surface, the three inner surfaces and two outer surfaces together form two square bores for allowing the protrusions of the corner connector to be inserted therein.

2. The cabinet frame for easy assembly according to claim 1, wherein each of the three inner surfaces of the longitudinal capping piece or the transverse capping piece is provided with square fitting holes and circular fitting holes at intervals.

3. The cabinet frame for easy assembly according to claim 2, wherein, a corner of each of the two outer surfaces of the longitudinal capping pieces is formed with an extension strip for forming a guide groove.

4. The cabinet frame for easy assembly according to claim 3, wherein the upper frame and the lower frame are of equal structure, which is constituted of two front transverse capping pieces, two side transverse capping pieces and four corner connectors, a corner of each of the two outer surfaces of the front transverse capping pieces is formed with an extension strip for forming a guide groove, the front transverse capping pieces having the same dimension as that of the longitudinal capping pieces, a corner of the outer surface of each side transverse capping pieces is provided with an extension strip for forming a groove.

5. The cabinet frame for easy assembly according to claim 4, wherein each surface of the prismatic rod is provided with holes corresponding to square holes and circular holes on the inner surfaces of the longitudinal capping pieces.

* * * * *